US005357719A

United States Patent [19]

Lewis

[11] Patent Number: 5,357,719

[45] Date of Patent: Oct. 25, 1994

[54] ROTATABLE GUTTER SYSTEM

[76] Inventor: Eric E. Lewis, 4975 SE. 35th Ave., Ocala, Fla. 34480

[21] Appl. No.: 47,999

[22] Filed: Apr. 19, 1993

[51] Int. Cl.[5] ..... E04D 13/04

[52] U.S. Cl. ..... 52/11; 52/16

[58] Field of Search ..... 52/11, 12, 16

[56] References Cited

U.S. PATENT DOCUMENTS

| | | | |
|---|---|---|---|
| 538,108 | 4/1895 | Freeze | 52/11 |
| 1,141,204 | 6/1915 | Noce | 52/11 |
| 2,131,985 | 10/1938 | Strayer | 52/11 |
| 3,007,662 | 11/1961 | Featheringham | 52/11 |
| 3,091,055 | 5/1963 | Hegedusich | 52/11 X |
| 3,630,473 | 12/1971 | Landis | 248/48.2 |
| 4,061,151 | 12/1977 | Ward | 52/11 X |
| 4,072,285 | 2/1978 | Greenwood | 52/11 X |
| 4,116,008 | 9/1978 | Ward | 52/11 X |
| 4,117,635 | 10/1978 | Nelson | 52/11 X |
| 4,226,057 | 10/1980 | Wolcott | 52/11 X |
| 4,309,792 | 1/1982 | Faye | 52/11 X |
| 4,311,292 | 1/1982 | Deason | 52/11 X |
| 4,411,108 | 10/1983 | Kerester | 52/11 |
| 4,413,449 | 11/1983 | Faye | 52/16 |
| 4,446,658 | 5/1984 | Gouin | 52/11 |
| 4,669,232 | 6/1987 | Wyatt | 52/11 |
| 4,696,131 | 9/1987 | Schreffler | 52/11 |
| 4,709,516 | 12/1987 | Gleaves | 52/11 |
| 4,745,657 | 5/1988 | Faye | 52/11 X |
| 4,807,406 | 2/1989 | Densmore | 52/11 |
| 4,813,190 | 3/1989 | Wittig | 52/11 |
| 4,837,987 | 6/1989 | Fender | 52/11 |
| 4,912,888 | 4/1990 | Martin | 52/11 X |
| 5,146,718 | 9/1992 | Baskett | 52/11 |
| 5,184,435 | 2/1993 | Sherman | 52/11 X |
| 5,255,477 | 10/1993 | Goodspeed | 52/11 |

*Primary Examiner*—Carl D. Friedman
*Assistant Examiner*—Beth A. Aubrey
*Attorney, Agent, or Firm*—Frijouf, Rust & Pyle

[57] ABSTRACT

An apparatus is disclosed for an improved rotatable gutter system for mounting on a building for disposing of debris collected therein. The apparatus comprises a plurality of supporting brackets mounted to the building with each supporting brackets having a journal mount. A rod is rotatably supported in the journal mounts and defines an axis of rotation. An elongated trough is longitudinally mounted on the rod by a plurality of trough supports. An eccentric is affixed to the rod with a cable being affixed to the eccentric. Energy applied to the cable is transmitted to the eccentric to rotate the elongate trough about the rotational axis into an inverted position to permit debris collected in the trough to fall therefrom. The eccentric provides a variably transmittal of the energy from the cable to the rod.

14 Claims, 5 Drawing Sheets

ROTATABLE GUTTER SYSTEM

BACKGROUND OF THE INVENTION

1. Field of the Invention

This invention relates to an apparatus for remotely cleaning a gutter mounted on a building. More specifically, this invention relates to a rotatable gutter system for inverting the gutter to permit debris collected therein to fall therefrom.

2. Information Disclosure Statement

Gutters are commonly used on buildings to collect rain water flowing from a sloped roof and to direct the rain water away from the building. Gutters not only prevent soil erosion adjacent to the building but also reduce damage to foundations and basements caused by water seepage into the soil adjacent to the building.

A problem associated with gutters is the tendency to collect leaves and other debris within the gutter. Often the collect leaves and other debris clogs the gutter rendering the gutter ineffective to collect rain water. After the gutter is clogged, the rain water will overflow down the side of the building thereby defeating the original purpose of the gutter. Furthermore, the rain water flowing down the side of the building may cause rot and mildew damage. Moreover, such debris accumulated in the gutter can be unsanitary.

Another problem occurs when freezing weather causes ice and snow to accumulate in the gutter, thereby preventing water from draining through the gutter. Improper drainage of a gutter can result in leakage through the roof to the interior, gradually rotting of roofing material and inner structure. Furthermore, the weight of ice may weaken the gutter causing the gutter to become deformed or detached from the building.

Accordingly, gutters must be cleaned periodically. Gutter cleaning is usually accomplished by using a ladder or climbing on the roof to reach the gutter. The gutter is then cleaned by hand or with a high pressure hose or a combination thereof. Both methods are time consuming and involve dangers such as falling from roof or ladder, or cuts resulting from sharp metallic parts or exposed fasteners during hand cleaning. Because of these problems, the prior art has attempted to develop a safer, quicker and more convenient methods for cleaning gutters.

The prior art discloses a number of proposed solutions to the problem of gutter cleaning. More specifically, a variety of devices have been disclosed for cleaning gutters by remotely rotating the gutter or a portion thereof thus discharging the debris collected therein.

U.S. Pat. No. 4,061,151 to Ward (1977) and U.S. Pat. No. 4,116,008 to Ward (1978) disclosed devices for manipulating a gutter to facilitate the dumping of debris from the gutter. Mounting structure supported the gutter for rotation about a longitudinal axis of the gutter with the longitudinal axis being located within the gutter between an upper edge and a bottom whereby the radius of rotary motion of the gutter is less than the depth of the gutter. A crank assembly was connected to a drive apparatus to transmit power to the drive apparatus for rotating the gutter over a reciprocatory rotational excursion. In addition, structure was disclosed for providing for fluid communication between two gutters rotatable relative to one another without inhibiting the relative rotatability therebetween.

U.S. Pat. No. 4,117,635 to Nelson, (1978) disclosed means for cleaning gutters about the caves of a house including support means which, when rotated, inverted the gutter so that any leaves or other debris would be discharged. The apparatus included remotely operated means to cause discharge of debris from the gutter by rotation of the support means.

U.S. Pat. No. 4,411,108 to Kerester (1983) related to a rotatable gutter system including a longitudinally elongated gutter having a plurality of supports and a pulley and cable drive mechanism. The support were attached to the facial board of a building with each support including a support bracket for attachment to the gutter. The gutter could be rotated into a substantially inverted position for emptying debris therefrom by a cable actuated pulley affixed to one end of the gutter. A specially designed downspout having a gutter receiving aperture permitted unhampered rotation of the gutter.

U.S. Pat. No. 4,807,406 to Densmore (1989) disclosed a self-cleaning gutter system formed from two, horizontal, gutter halves interlocked along a gutter bottom. The back gutter half, immediately adjacent to the house or building was fixedly attached thereto. The front half of the gutter was journaled to the rod and connected through a gearing system to ground level geared handle. The operation of the handle will cause the front half of the gutter to open 180 degrees, thereby dumping debris, ice and snow to the ground.

U.S. Pat. No. 4,837,987 to Fender (1989) related to a gutter apparatus for directing rain water to a downspout that was particularly adapted to be inverted to permit debris collected in the gutter to fall therefrom. The gutter apparatus includes a rod that defines a rotational axis which was supported by a plurality of fixed supporting brackets to extend along a lower edge of the roof at a spaced distance therefrom. A plurality of supports fixed to the rod mounted the gutter trough to the rod so that gutter trough could be rotated from an upright operational position to an inverted dumping position. The gutter was rotated by a rotatable drive means which was operated by a person positioned safely on the ground.

These prior art disclosures greatly enhanced the art of gutter cleaning by disclosing devices which allow cleaning to be safer, easier and faster than previous hand cleaning methods. These prior art devices were safer because these devices allowed remote cleaning by a person on the ground, thereby avoiding the dangers associated with hand cleaning such as climbing ladders or onto roofs. Operating from the ground resulted in an easier and faster operation by avoiding the set-up time associated with the hand-cleaning method. The gutter was merely rotated to the dumping position, washed with a hose, and again rotated back into the operative position, all from the ground level. The ease of operation promoted regular and frequent cleaning allowing the gutter to operate more efficiently, and prevented unsanitary conditions resulting from decay of collected debris. Moreover, use of these devices reduced damage to the gutter caused by an overloaded condition as well as minimized wear and tear to the building, such as roof leaks or damage to roof surfaces due to exposure to foot traffic.

However, the devices disclosed in the prior art suffered from various shortcomings. One problem was the utilization of relatively complicated drive mechanisms such as gearboxes, pulleys and cranks. These drive mechanisms were necessary to provide the mechanical advantage necessary to rotate the gutter when the gutter was under a heavily loaded condition. Such drive mechanisms were more expensive to manufacture, more difficult to install, and required greater maintenance than simpler devices. Some devices had relatively complicated mounting systems to provide support of and pivoting for the gutter, further increasing cost and difficulty of installation.

Some prior art devices required specially designed gutter troughs. Standard gutters could not be incorporated into the systems, thereby limiting utility of the device. Many of the drive mechanisms required multiple actions for complete operation. First, the drive mechanisms were manipulated into a position to discharge the debris from the gutter. Second, the drive mechanisms were manipulated to return the gutter to the operative position.

Other prior art devices did not enhance the structural strength of the gutter, but were merely supported in a manner similar to conventional fixed gutters. These gutters were supported on the building in such a way as to allow the gutters to sag and become distorted under normal use. As a result, these gutters were less effective and less durable.

The prior art rotatable gutters, as well as conventional fixed gutters, could not be easily removed from the building in areas where winter snows collect and build up on roofs. Thus, the gutters had to endure the stress of occasional high loads such as snow and ice. Moreover, inability to remove gutters during the roofing procedure exposed the gutters to damage by workmen, and allowed for the collection of debris from the roofing procedure.

Finally, some of the prior art rotatable gutters were somewhat unsightly, having components such as cranks, pulleys and gearboxes mounted on the external walls of the building. Therefore, a system which overcomes these difficulties with the prior art would be very desirable.

Therefore, it is an object of the present invention to provide an improved apparatus to remotely clean a gutter mounted on a building which incorporates a drive mechanism which is simple, yet provides the mechanical advantage necessary to rotate a loaded gutter.

Another object of the present invention is to provide an improved apparatus to remotely clean a gutter mounted on a building which allows for the installation and removal of up to a 20-foot section of gutter by one person.

Another object of the present invention is to provide an improved apparatus to remotely clean a gutter mounted on a building which is simple to install, requiring no special tools and no special skill or knowledge of construction.

Another object of the present invention is to provide an improved apparatus to remotely clean a gutter mounted on a building which utilizes commercially available gutter shapes.

Another object of the present invention is to provide an improved apparatus to remotely clean a gutter mounted on a building upon which existing gutters can be easily retrofitted.

Another object of the present invention is to provide an improved apparatus to remotely clean a gutter mounted on a building upon which enables the gutter to automatically return to the upright position, and maintain the upright position under normal use without the need of mechanical devices.

Another object of the present invention is to provide an improved apparatus to remotely clean a gutter mounted on a building which adds rigidity and structural strength to the gutter.

Another object of the present invention is to provide an improved apparatus to remotely clean a gutter mounted on a building which allows for easy removal of the gutter.

Another object of the present invention is to provide an improved apparatus to remotely clean a gutter mounted on a building which is visually appealing.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full under standing of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved rotatable gutter system for mounting on a building for disposing of debris collected therein. The apparatus comprises a plurality of supporting brackets mounted to the building. Each of the supporting brackets has a journal mount. A rod is rotatably supported in the journal mounts of the supporting brackets and defines an axis of rotation. An elongated trough is longitudinally mounted on the rod by a plurality of trough supports. The elongated trough defines a center of mass and is mounted on the rod with the center of mass being vertically beneath the axis of rotation when the elongated trough is in an upright position. An eccentric means is affixed to the rod with a cable being affixed to the eccentric means for remotely transmitting energy to the eccentric means. Preferably, the cable is partially wound about the eccentric means for variably transmitting energy from the cable to the rod. More preferably, the cable hangs downwardly and permits the rod to be manually rotated from a location below the rotatable gutter system.

The eccentric means variably transmits energy from the cable to the rod to rotate the elongated trough about the rotational axis to an inverted position to permit debris collected therein to be discharged therefrom. Preferably, each of the plurality of supporting brackets defines a stop structure which limits the rotation of tile trough about the rotational axis.

Preferably, the elongated trough comprises a first and second opposing sidewall. The trough supports are affixed to the first and second opposing sidewalls of the elongated trough mounted on the rod, with the first opposing sidewall located proximate the building and with the second opposing sidewall located remote from the building. Most preferably, the trough supports are mounted to the rod at spaced intervals along the rod for uniformly supporting the elongated trough on the rod.

Upon the application of rotational energy to the rod, the plurality of trough supports enable rotation of the elongated trough about the axis of rotation to an inverted position, thus permitting the debris to be discharged from the elongated trough. Upon the removal of rotational energy from the rod, the plurality of trough supports enable rotation of the elongated trough about the axis of rotation to the upright position. Preferably, each of the plurality of supporting brackets defines a stop structure. Upon the application of rotational energy by the drive means once the elongated trough is in the inverted position, the stop structures prevent further rotation of the elongated trough about the axis of rotation.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several FIGURES of the drawings.

DETAILED DISCUSSION

Figure 1:
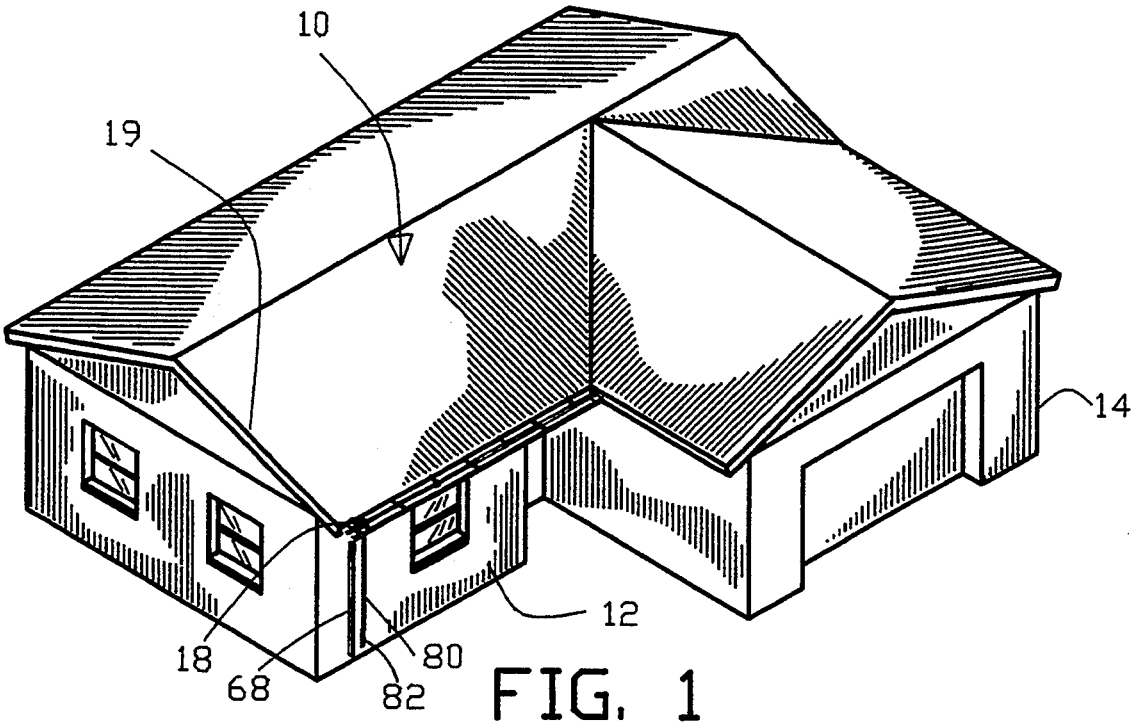
FIG. 1 is an isometric view of an improved rotatable gutter system mounted on a building.

FIG. 1 is an isometric view of an improved rotatable gutter system 10 mounted on a wall 12 of a building 14 adjacent a lower edge 18 of a sloped roof 19. FIGS. 2–8 illustrates various views of the major components of the gutter system 10, including a plurality of supporting brackets 20, a pulley 30, a keeper 35, a rod 40, a plurality of trough supports 50, elongated trough 60, eccentric means shown as a cam 70, and a cable 80.

Preferably, the supporting brackets 20 are fabricated 06 aluminum or other like material. As shown best in FIGS. 3–5, each of the supporting bracket 20 has a vertical member 21, a horizontal member 22, and an angled member 23. Each of the supporting bracket 20 is secured to the wall 12 by mounting screws 24 extending through the vertical member 21. A stop structure 25 is defined by a top surface 26 of the supporting bracket 20. A pulley 30 is mounted on the horizontal member 22 through a shaft 31. An outer rim 32 of the pulley 30 defines a guide groove 34.

Figure 3:
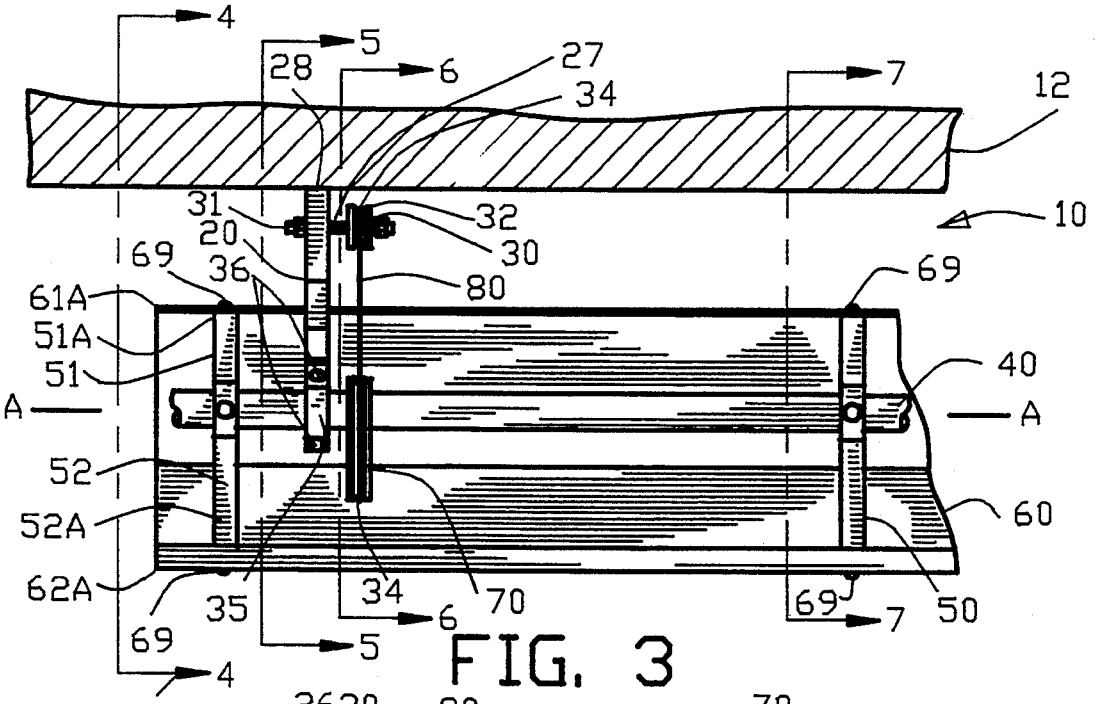
FIG. 3 is a top view of rotatable gutter of FIGS. 1 and 2.
Figure 5:
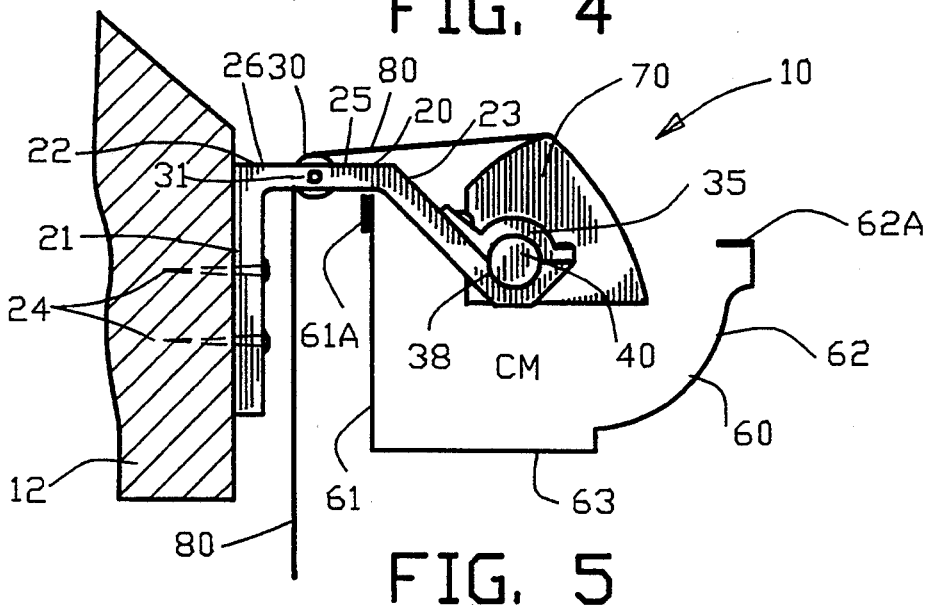
FIG. 5 is a sectional view along line 5—5 of FIG. 3.
Figure 6:
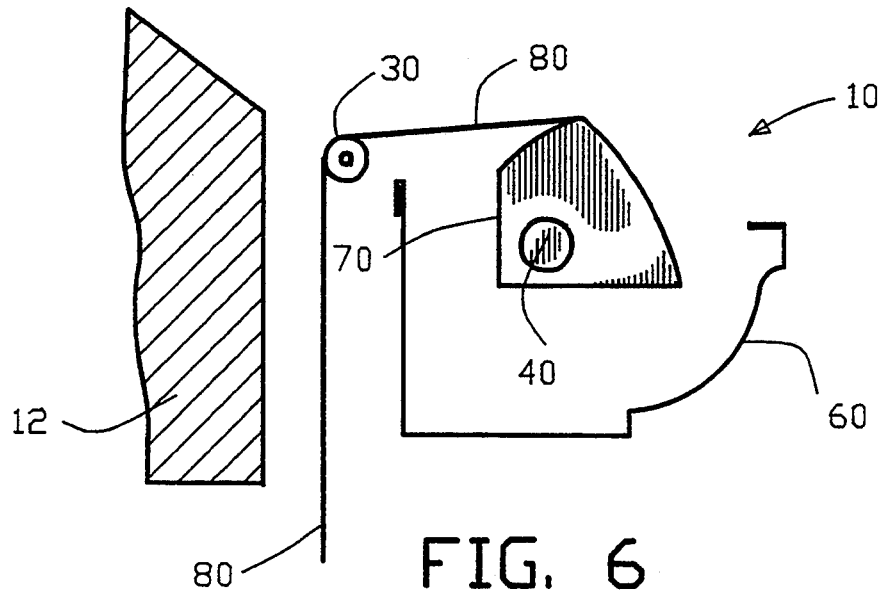
FIG. 6 is a sectional view along line 6—6 of FIG. 3.
Figure 7:
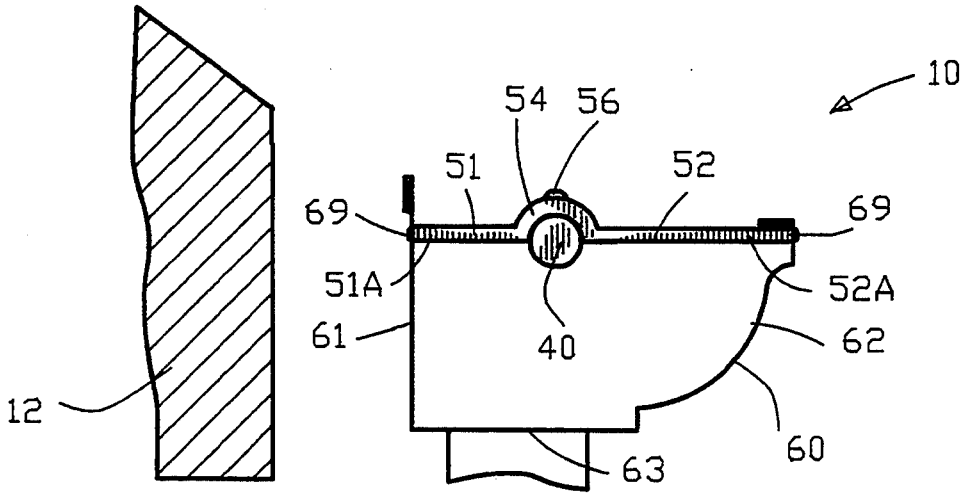
FIG. 7 is a sectional view along line 7—7 of FIG. 3.

As best shown in FIG. 5, the keeper 35 is mounted on supporting bracket 20 by keeper screws 36 to define a journal 38. The rod 40 is rotatably mounted in the journal 38 and defines an axis of rotation A—A as shown in FIG. 3. Preferably, the rod 40 is constructed of one-half inch metallic tubing. An optional plastic bushing (not shown) may be inserted in each assembled supporting bracket 20 and keeper 35 to enhance the rotation of the rod 40 and for preventing a metal-to-metal contact therebetween.

The trough supports 50 are mounted on the rod 40 at spaced intervals along the rod 40. Each of the trough supports 50 has a first arm 51 and a second arm 52 with a central collar 54 therebetween. The first arm 51 has a first end 51A and second arm 52 has a second end 52A with the first arm 51 being shorter than the second arm 52. The central collar 54 is fitted over the rod 40 with a support screw 56 extending through the central collar 54 for securing each of the trough supports 50 to the rod 40.

Figure 4:
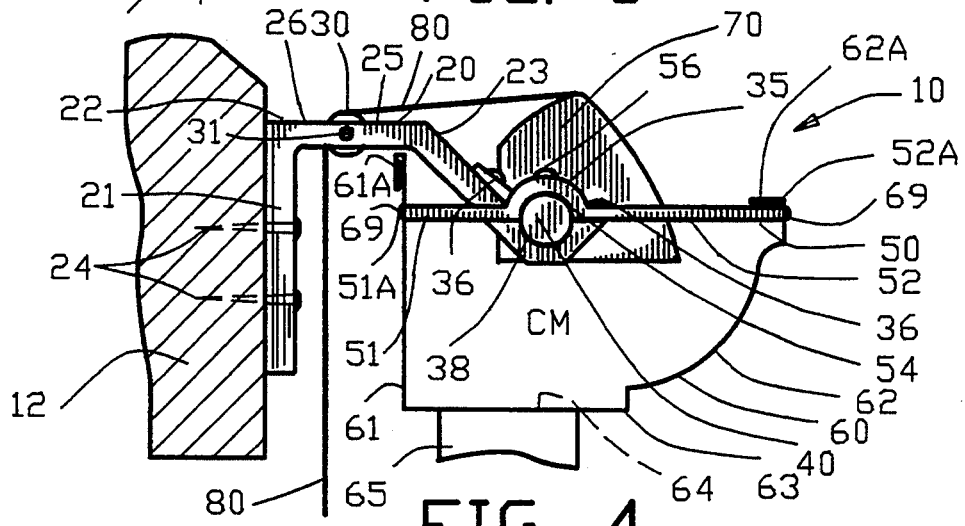
FIG. 4 is a view along line 4—4 in FIG. 3.

As shown in FIGS. 4 and 5, the elongated trough 60 has a first and second opposing sidewall 61 and 62 interconnected by bottom wall 63 for defining a center of mass CM. The first and second sidewalls 61 and 62 have a first and a second lip 61A and 62A.

Figure 2:
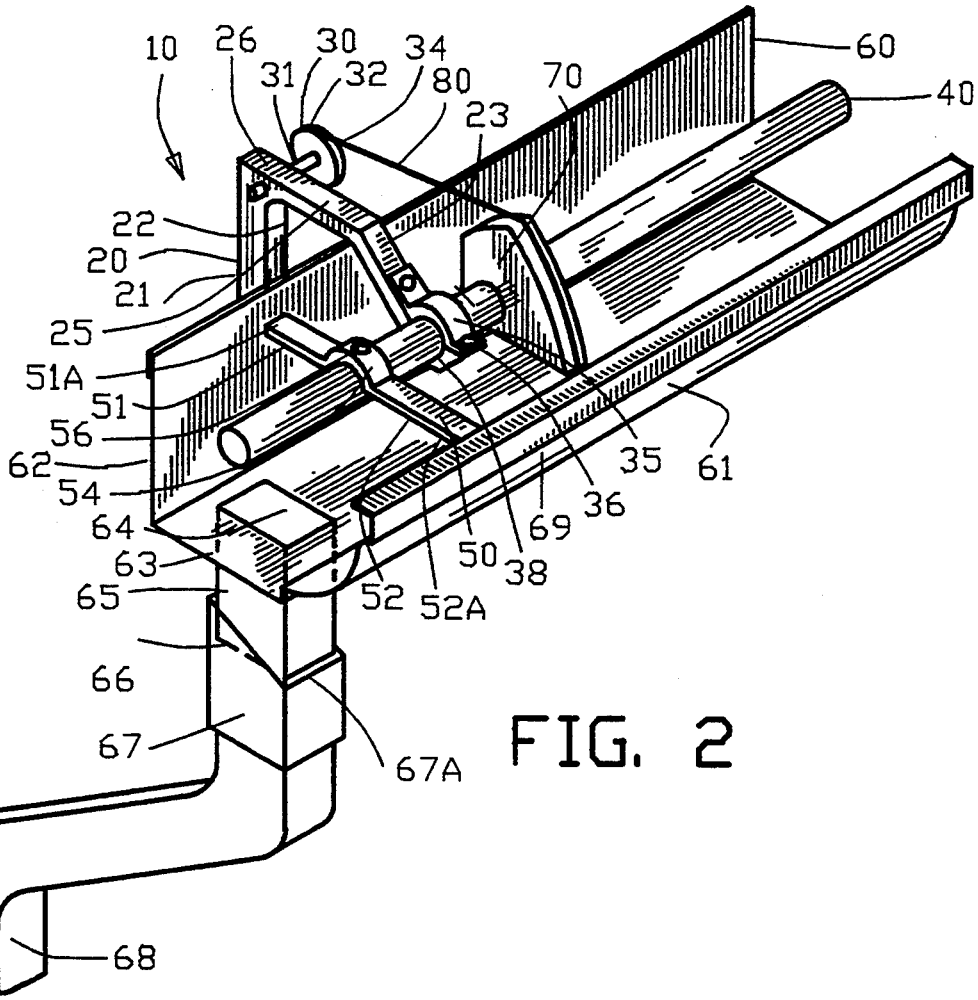
FIG. 2 is an enlarged partial view of the apparatus in FIG. 1.

As best shown in FIGS. 1 and 2, a drain aperture 64 is defined in the bottom wall 63. An outflow downspout 65 is affixed to the bottom wall 63 at an angle substantially perpendicular to elongated the trough 60 to communicate with the drain aperture 64. Preferably, the outflow downspout 65 is fabricated from a section of a standard shaped gutter downspout having a length of approximately six inches. The outflow downspout 65 defines a discharge aperture 66 being substantially parallel to a horizontal plane.

A collection box 67 is mounted on the wall 12 in a spaced apart vertical alignment with the discharge aperture 66 when elongated trough 60 is in the upright position. Collection box 67 defines an intake opening 67A with forms angle of approximately 30 degrees with a horizontal plane. A downspout 68 is mounted on the wall 12 in a spaced apart vertical alignment and in fluid communication with collection box 67 enabling downspout 68 to rotate relative to the collection box 67. The downspout 68 is of conventional design. The elongated trough 60 is mounted to the rod 40 and uniformly supported thereon by the trough supports 50 with the first sidewall 61 being located proximate to the wall 12 of the building 14 and with the second sidewall 62 being located remote from the wall 12. The first and seconds ends 51A and 51B of the trough supports 50 are affixed to the first and second sidewalls 61 and 62 by screws 69 attached through the first and second lips 61A and 62A. Preferably, the screws 69 are non-corrosive and self-tapping and the trough supports 50 are predrilled at first and second ends 51A and 52A to facilitate the receiving of screws 69.

The first and second arms 51 and 52 of the trough supports 50 are sized relative to the trough 60 such that when the trough 60 is mounted on the rod 40 by the trough supports 50, the center of mass CM of trough 60 is suspended directly below the axis of rotation A—A and the bottom wall 63 of the trough 60 is substantially parallel to a horizontal plane as shown in FIGS. 3–5. The supporting brackets 20 are shaped so as to accommodate the mounting of standard gutter shapes in the above-described manner and to ensure adequate clearance from the building 14 during operation of the invention.

Figure 8:
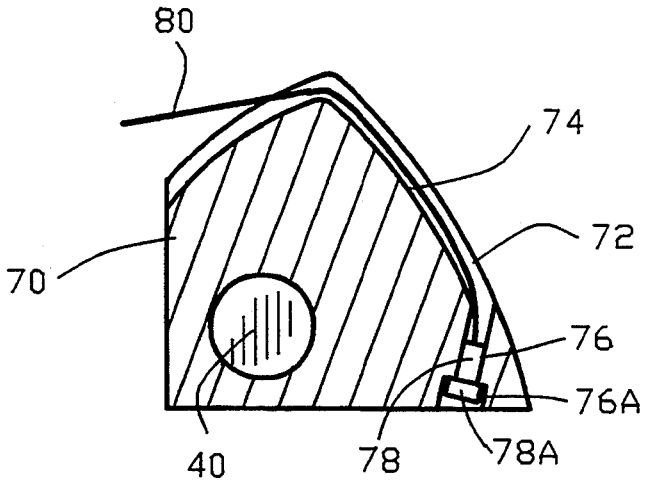
FIG. 8 is an enlarged sectional view of an eccentric shown in FIG. 6.

Preferably, the cam 70 is made of aluminum and is affixed to the rod 40 adjacent to the supporting bracket 20 in alignment with the pulley 30. As shown best in FIGS. 3 and 8, an outer rim 72 of the cam 70 defines a groove 74. A bore 76 having a counterbore 76A is drilled through the cam 70 into the groove 74. Preferably, the cable 80 is made of plastic coated aircraft cable with a stop rivet 78 being affixed to the end of cable 80 by soldering or crimping. The cable 80 is attached to the cam 70 by threading the cable 80 through the bore 76 with a head 78A of the stop rivet 78 being received in the counterbore 76A. The cable 80 extends from bore 76 and is partially wound about the cam 70 within groove 74 as shown in FIG. 8. The cable 80 extends from the cam 70 into the guide groove 34 of the pulley 30. As shown in FIG. 1, the cable 80 extends downwardly from the pulley 30 a sufficient length to be graspable by an operator (not shown) on the ground. A spring 82 is affixed between the end of the cable 80 and the wall 12 for maintaining tension on cable 80.

Figure 9:
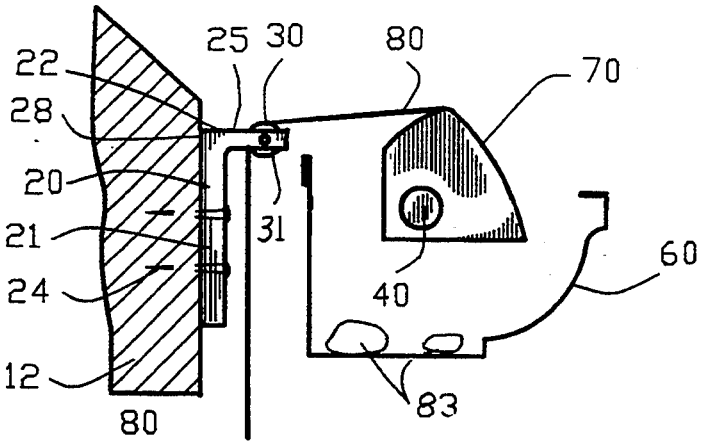
FIG. 9 is a sectional view similar to FIG. 6 showing the elongated trough in an upright position.

Once the improved rotatable gutter system 10 has been assembled and mounted on the building 14 as described above, the improved rotatable gutter system 10, passively operates in the same manner as a conventional gutter system. Rain water flows from the sloped roof 19 and is received in elongated trough 60 to flow through drain aperture 64 into outflow downspout 65. The collection box 67 receives the water from outflow downspout 65 for directing the rain water to flow through the downspout 68 and away from the building 14. The rain water collection process collects debris 83 as shown in FIG. 9. The rotatable gutter system 10 enables the removal of debris 83 the elongated trough 60 to be easily performed by the person (not shown) standing on the ground.

FIGS. 9–12 illustrates the operation of the improved rotatable gutter system 10. The cable 80 is grasped by the person (not shown) positioned on the ground and downward force is applied by the person. The pulley 30 converts the vertical downward force to a horizontal force that is transmitted from the cable 80 to the cam 70. The cam 70 begins to pivot about the axis of rotational A—A, converting linear energy of the cable 80 to rotational energy. The cam 70 rotates the rod 40 in concert with the cam 70 about the axis of rotation A—A.

The torque of the rod 40 is transmitted to the trough 60 at a number of locations by the multiple trough supports 50. Since the torque is transmitted essentially by the rod 40 and not by the trough 60, there is limited strain and fatigue on the trough 60. Accordingly, the cam 70 and cable 80 may be mounted thereon at virtually any position along the rod 40 without concern for adverse problems resulting from rotational torque or overstressing of the trough. Furthermore, the multiple trough supports 50 provide rigidity and add strength to trough 60 thereby reducing bending and sagging of the trough 60.

Figure 10:
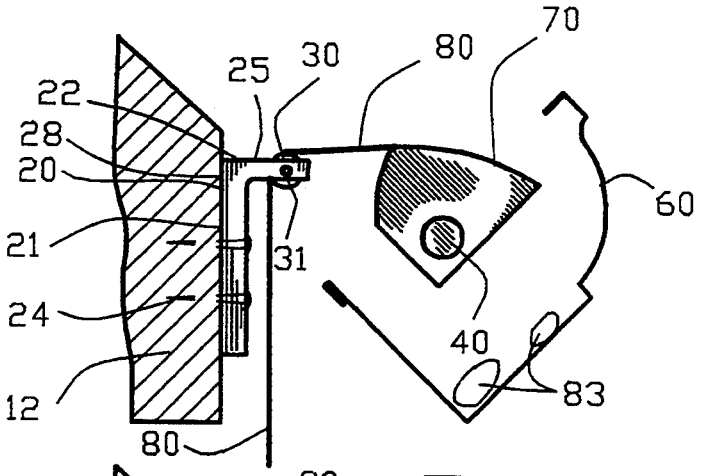
FIG. 10 is a sectional view similar to FIG. 6 showing the elongated trough partially rotated from the upright position shown in FIG. 9.
Figure 11:
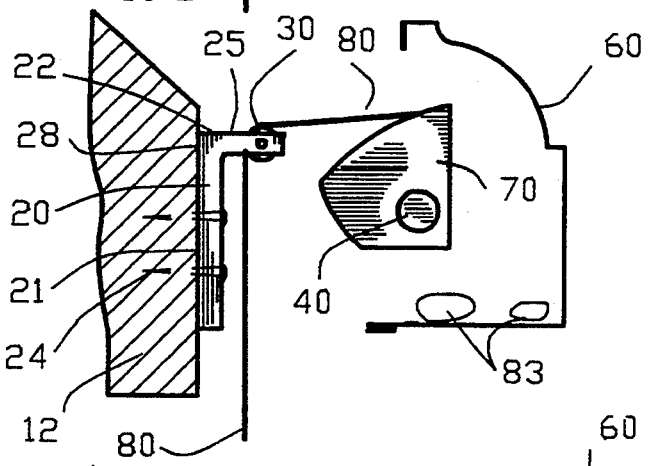
FIG. 11 is a sectional view similar to FIG. 6 showing the elongated trough further rotated from the position shown in FIG. 10.

The eccentricity of the cam 70 has the effect of varying the length of the moment arm. The moment arm is the distance between a point on the cam 70 where a force is applied to the cam and the axis of rotation A—A. The eccentricity of the cam 70 changes the length of the moment arm to provide a maximum mechanical advantage when the trough 60 is loaded with debris 83 as shown in FIG. 9. As the trough 60 is rotated as shown in FIGS. 10 and 11, the change in the length of the moment arm that occurs is approximately equal to the change of the force required to keep trough 60 in constant motion, thus giving the feeling of a constant resistance and a smoother operation.

Figure 12:
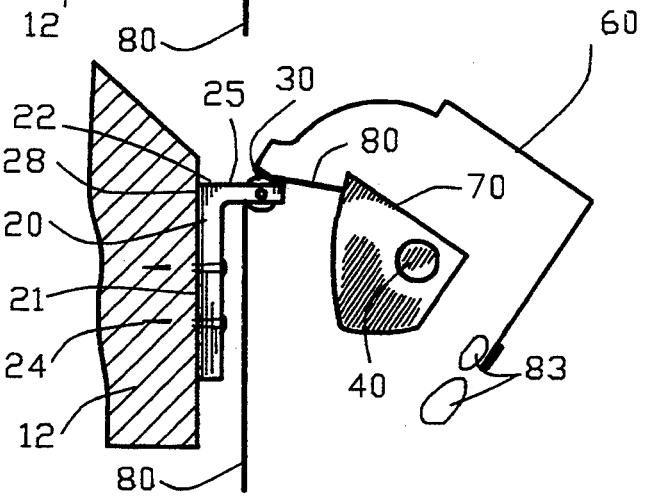
FIG. 12 is a sectional view similar to FIG. 6 showing the elongated trough in an inverted position.

As the force is applied, the trough 60 is rotated about the axis of rotation A—A from the upright position of FIG. 9 toward an inverted position shown in FIG. 12. The outflow downspout 65 swings away from wall 12, clear of collection box 67. Clearance is permitted by different angles of the plane of the discharge aperture 66 of outflow downspout 65 and the plane of the intake opening 67A of collection box 67. As the trough 60 approaches the inverted position shown in FIG. 12, accumulated debris 83 begins to fall from the trough 60 to the ground. Upon reaching the inverted position, the second sidewall 62 impacts the stop structure 25 defined by the top surface 26 of the supporting bracket 20 to prevent further rotation of the trough 60. The rate and timing by which the debris 83 falls depends on the composition, compactness, water content, and other factors. Once the trough 60 has come to rest in the inverted position, a high pressure hose (not shown) can be used to remove any remaining debris 83 and rinse the trough 60.

The stop structure 25 on the supporting bracket 20 limits the trough 60 to a rotation of less than 180 degrees, thereby preventing the center of mass C from rotating to a point above or beyond the axis of rotation A—A. This ensures that upon the release of the force on the cable 80, the trough 60 will rotate in the opposite direction by the force of gravity to return to the upright position as shown in FIG. 9 after the contents have been removed. The discharge aperture 66 of outflow downspout 65 returns to a position vertically above collection box 67, as shown in FIG. 2. When the trough 60 is returned into the upright position as shown in FIG. 9, the trough 60 hangs in balance on the rod 40 by gravity without the need for mechanical stops. The trough 60 will remain upright under normal use, until the cleaning operation is again initiated.

Figure 13:
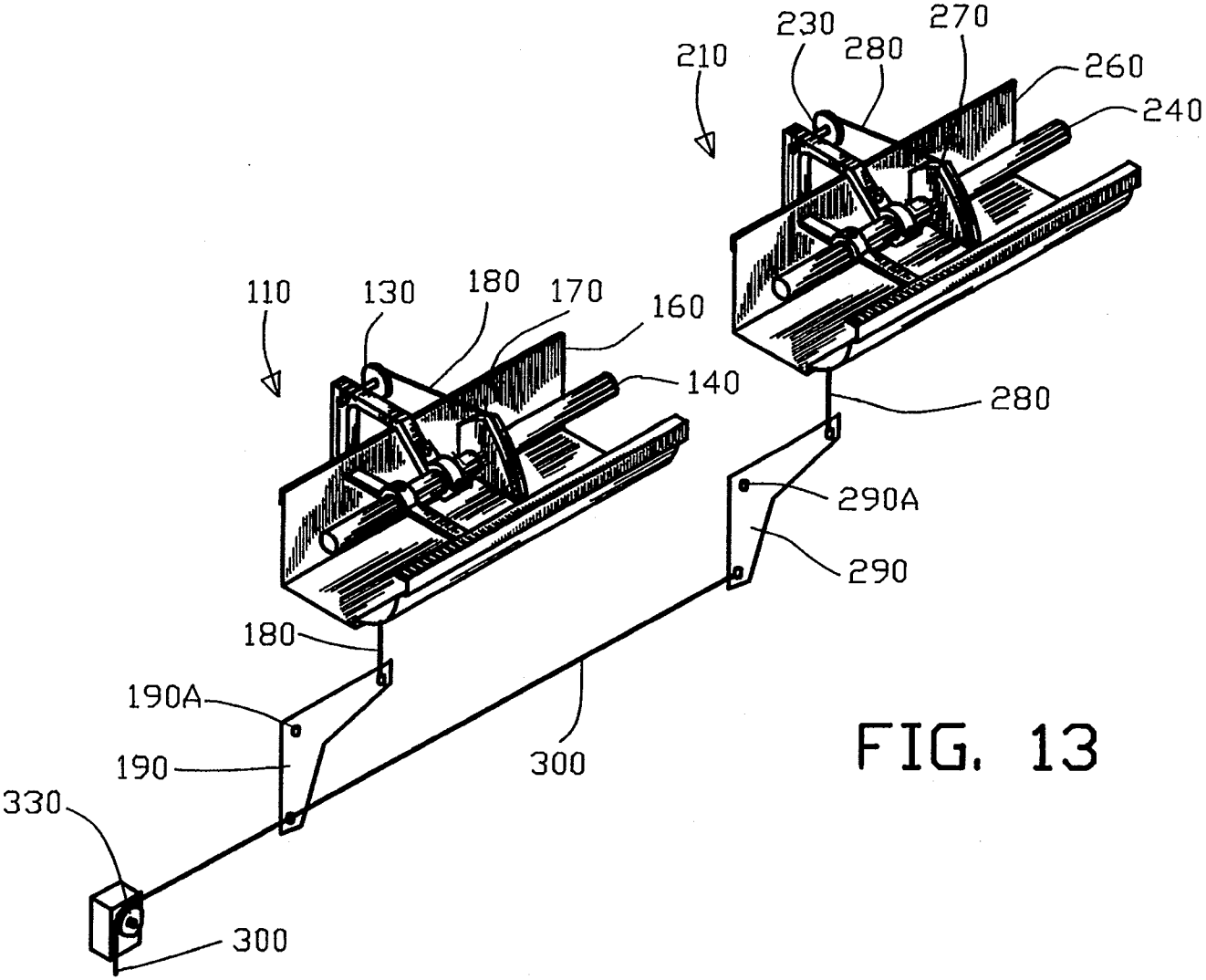
FIG. 13 is an isometric view of a second embodiment of the invention utilizing multiple cams and showing the elongated trough in an upright position.

FIG. 13 depict a second embodiment of the invention comprising a first and a second rotatable gutter system 110 and 210. When the mounting troughs 160 and 260 are in excess of 10 feet, it is desirable to use multiple cams 170 and 270. The rods 140 and 240 may be connected by conventional rod couplings (not shown). A first and a second cable 180 and 280 are connected to a first and a second bellcrank 190 and 290. The first and second bellcranks 190 and 290 are pivotably mounted to the wall 12 by a first and a second pivot 190A and 290A. A cable 300 is connected to the first and second bellcranks 190 and 290 and pass along a pulley 330 to extend downwardly from the pulley 330 a sufficient length to be graspable by an operator (not shown) on the ground. This embodiment allows for the cable 300 to operate multiple cams 170 and 270 from a single location.

When the cable 300 is grasped by the person (not shown) positioned on the ground and downward force is applied to the cable 300. The pulley 330 transfer the downward vertical force to a horizontal force that is applied to the bellcranks 190 and 290. The horizontal force applied to the bellcranks 190 and 290 cause a clockwise rotation of the bellcranks 190 and 290 about the pivots 190A and 290A. This clockwise rotation of the bellcranks 190 and 290 about the pivots 190A and 290A results in a downward force being applied to cables 180 and 280 causing rotation of the troughs 160 and 260 as described heretofore.

The improved rotatable gutter system 10 offers a number of advantages over the prior art. The rotation is accomplished by the eccentric cam 70 which is simple, yet provides the mechanical advantage necessary to smoothly rotate the trough 60. The eccentric design of the cam 70 overcomes inertia of the loaded trough 60 with minimal effort. The trough 60 automatically returns to the upright position and is maintained by gravity in the upright position under normal use without the need of mechanical devices. The trough 60 is supported in multiple locations, thereby exhibiting increased rigidity and strength and decreased fatigue and strain caused by operation. Installation and removal is simple and long sections of trough 60 can be installed by a single worker requiring no special tools and no special skill in or knowledge of construction. The trough 60 can be easily removed by unscrewing and removal of the keeper 35 which allows the trough 60 and the rod 40 to be lifted off the supporting brackets 20. Cost is minimized by utilizing commercially available trough shapes, or by retrofitting existing troughs. Furthermore, the system is visually appealing.

The present invention overcomes the aforementioned inadequacies of the prior art by the provision of a drive system that is simple, yet nevertheless which provides the mechanical advantage necessary to rotate a loaded gutter without a complicated drive mechanism. This simpler drive mechanism reduces cost of manufacture, difficulty of installation, and amount of required maintenance. The present invention is easily affordable to the average homeowner at a cost not substantially greater than conventional fixed gutters.

The present invention discloses a simpler mounting system which is easier to install and disassemble than previous devices. The present invention allows the installation or removal of up to a 20-foot section of gutter by only one person with no special tools, and no special skill or knowledge of construction. The present invention is easily adapted to existing gutters with all components being designed for use with commercially available gutter shapes.

The present invention enables the gutter to automatically return to the upright position, and maintain the upright position under normal use without the need of mechanical devices. In addition, the present invention adds rigidity and structural strength to the gutter to prevent sag and deflection from overloading, thus improving the effectiveness of the gutter, and extending its useful life. The present invention allows for easy removal of the gutter when special circumstances require. This allows for the avoidance of the stress of occasional high loads such as snow and ice, or other circumstances under which the gutter may be damaged. Lastly, the present invention provides a system which is not visually objectionable and appears to be almost identical in appearance to a conventional fixed gutter system.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved rotatable gutter system for mounting on a building for disposing of debris collected therein, comprising:

a plurality of supporting brackets mounted to the building;

each of said supporting brackets having a journal mount;

a rod rotatably supported in said journal mounts of said supporting brackets and defining an axis of rotation;

an elongated trough defining a center of mass;

a plurality of trough supports for longitudinally mounting said elongated trough on said rod with said rod being disposed substantially above said center of mass of said elongated trough for maintaining said elongated trough in an upright position:

eccentric means affixed to said rod;

a cable affixed to said eccentric means for remotely transmitting energy to said eccentric means;

said eccentric means variably transmitting energy from said cable to said rod to rotate said elongated trough about said rotational axis from said upright position into an inverted position for inverting said elongated trough to permit debris collected therein to fall therefrom; and said center of mass of said elongated trough rotating said elongated trough from said inverted position into said upright position upon release of said energy from said cable.

2. An improved rotatable gutter system as set forth in claim 1, wherein said cable is partially wound about said eccentric means for variably transmitting energy from said cable to said rod.

3. An improved rotatable gutter system as set forth in claim 1, wherein said cable hangs downwardly for permitting said rod to be manually rotated from a location below said rotatable gutter system.

4. An improved rotatable gutter system as set forth in claim 1, wherein each of said plurality of supporting brackets defines a stop structure for limiting the rotation of said trough about said rotational axis upon the transmission of energy to said eccentric means.

5. An improved rotatable gutter system for mounting on a building for disposing of debris collected therein, comprising:

a plurality of supporting brackets mounted to the building;

each of said supporting brackets having a journal mount;

a rod rotatably supported in said journal mounts and defining an axis of rotation;

drive means connected to said rod for applying rotational energy to said rod;

an elongated trough;

said elongated trough defining a center of mass;

a plurality of trough supports for mounting said elongated trough on said rod with said center of mass of said elongated trough being vertically beneath said axis of rotation when said trough is in an upright position;

said plurality of trough supports enabling rotation of said elongated trough about said axis of rotation to an inverted position upon the application of rotational energy to said rod to permit the debris to fall from said elongated trough; and said plurality of trough supports enabling rotation of said elongated trough about said axis of rotation to said upright position upon the removal of rotational energy from said rod.

6. An improved rotatable gutter system as set forth in claim 5, wherein said elongated trough comprises a first and second opposing sidewall; and said trough supports being affixed to said first and second opposing sidewalls on said rod, with said first opposing sidewall located proximate the building and with said second opposing sidewall located remote from the building.

7. An improved rotatable gutter system as set forth in claim 5, wherein said trough supports are mounted to said rod at spaced intervals along said rod for uniformly supporting said elongated trough on said rod.

8. An improved rotatable gutter system as set forth in claim 5, wherein each of said plurality of supporting brackets defines a stop structure for preventing said trough from rotating about said axis of rotation upon the application of rotational energy by said drive means when said elongated trough is in said inverted position.

9. An improved rotatable gutter system as set forth in claim 5, wherein said drive means comprises eccentric means affixed to said rod; and a cable attached to said eccentric means for remotely transmitting energy to said eccentric means to rotate said elongate trough about said axis of rotation.

10. An improved rotatable gutter system as set forth in claim 9, wherein said cable is partially wound about said eccentric means for variably transmitting energy from said cable to said rod.

11. An improved rotatable gutter system as set forth in claim 9, wherein said cable is partially inserted through said eccentric means for attaching to said eccentric means.

12. An improved rotatable gutter system as set forth in claim 5, wherein said drive means comprises a plurality of eccentric means affixed to said rod;

a plurality of pivot arms each operably attached to one of said plurality of eccentric means; and a cable attached to each of said pivot arms for remotely transmitting energy simultaneously to each of said plurality of eccentric means to rotate said elongate trough about said axis of rotation.

13. An improved rotatable gutter system as set forth in claim 5, wherein said drive means comprises eccentric means affixed to said rod and a downwardly hanging cable attached to said eccentric means for permitting said elongated trough to be manually rotated from a location below said rotatable gutter system.

14. An improved rotatable gutter system as set forth in claim 5, wherein said elongated trough comprises a plurality of trough sections;

said elongated trough further comprising joint means for operably joining each of said plurality of trough sections:

said rod comprising a plurality of rod sections;

said plurality of trough supports mounting each of said trough sections on one of said rod sections;

said plurality of trough supports enabling independent rotation of said each of said trough sections about said axis of rotation to an inverted position upon the application of rotational energy to each of said rod sections to permit the debris to fall from each of said trough sections; and said plurality of trough supports enabling independent rotation of each of said trough sections about said axis of rotation to said upright position upon the removal of rotational energy from each of said rod sections.

* * * * *